US011533992B2

(12) United States Patent
Payne et al.

(10) Patent No.: US 11,533,992 B2
(45) Date of Patent: Dec. 27, 2022

(54) FLEXIBLE SHELVING UNIT

(71) Applicant: GM Global Technology Operations LLC, Detroit, MI (US)

(72) Inventors: William P. Payne, Macomb, MI (US); Joshua L. Solomon, Berkley, MI (US); Hui-ping Wang, Troy, MI (US); Bradley J. Blaski, Sterling Heights, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/213,603

(22) Filed: Mar. 26, 2021

(65) Prior Publication Data

US 2022/0304465 A1 Sep. 29, 2022

(51) Int. Cl.
*A47B 57/04* (2006.01)
*A47B 57/10* (2006.01)
*A47B 96/02* (2006.01)

(52) U.S. Cl.
CPC ..... *A47B 57/045* (2013.01); *A47B 57/10* (2013.01); *A47B 96/028* (2013.01)

(58) Field of Classification Search
CPC ..... A47B 57/04; A47B 57/045; A47B 57/10; A47B 96/028; A47B 57/00; A47B 57/06; A47B 57/08; A47B 57/16; A47B 57/18; A47B 57/20
USPC ..... 211/150; 108/1
See application file for complete search history.

(56) References Cited

U.S. PATENT DOCUMENTS 1,692,930 A * 11/1928 Cummings ..... A47B 5/04 297/14
1,802,245 A * 4/1931 Foretich ..... A47B 96/027 248/222.51
2,305,629 A * 12/1942 Magnuson ..... A47B 43/00 211/195
2,644,591 A * 7/1953 Mcmahan ..... A47F 5/103 248/242
2,703,692 A * 3/1955 Felix ..... A47B 57/567 248/244
2,891,759 A * 6/1959 Holmboe, Sr. ..... E04G 25/04 248/246
2,906,486 A * 9/1959 Bellon ..... A47B 57/045 248/242
2,936,147 A * 5/1960 Stewart ..... G01G 23/37 248/243

(Continued)

*Primary Examiner* — Devin K Barnett
(74) *Attorney, Agent, or Firm* — Vivacqua Crane PLLC

(57) ABSTRACT

A flexible shelving unit includes a support frame having at least one vertical guide rack, the guide rack including an elongated slot. The shelf unit is supported by the guide rack. The shelf unit includes a shelf plate framed by a front reinforcement portion and by at least one side reinforcement portion. The shelf unit when in a release position is moved to selected upward and downward locations by vertical displacement of at least one locating pin connected to and extending from the at least one side reinforcement portion which is positioned and sliding within the elongated slot. A flat end face of the at least one side reinforcement portion directly contacts a plate face of the at least one vertical guide rack with the at least one side reinforcement portion and the shelf plate in a horizontal position to frictionally retain the shelf unit in the horizontal position.

9 Claims, 6 Drawing Sheets

(56) References Cited

U.S. PATENT DOCUMENTS 3,114,531 A * 12/1963 Weber ..... A47B 57/045 248/242
3,128,074 A * 4/1964 Schwarz ..... A47B 57/567 248/246
3,132,609 A * 5/1964 Chesley ..... A47B 57/54 108/189
3,158,349 A * 11/1964 Bergstrom ..... A47K 1/08 248/218.4
3,421,458 A * 1/1969 Nusbaum ..... A47B 5/04 108/77
3,429,540 A * 2/1969 Worallo ..... A47B 57/56 248/246
3,550,891 A * 12/1970 Scott ..... A47B 57/045 248/242
3,570,679 A * 3/1971 Edson ..... A47F 7/163 108/1
3,865,337 A * 2/1975 Towfigh ..... A47B 57/56 248/246
4,274,614 A * 6/1981 Worrallo ..... A47B 57/56 248/243
4,299,368 A * 11/1981 Winkler ..... A47B 57/56 248/246
4,353,469 A * 10/1982 Etchison, Jr. ..... H05K 7/1425 361/802
4,383,722 A * 5/1983 Weber ..... A47B 57/04 312/133
4,421,289 A * 12/1983 Sturm ..... A47B 57/56 248/246
4,563,722 A * 1/1986 Maroney ..... H05K 7/1425 361/212
4,688,681 A * 8/1987 Bergeron ..... A47F 7/08 211/195
4,791,873 A * 12/1988 Towfigh ..... A47B 5/04 108/134
4,919,282 A * 4/1990 Duff ..... A47F 5/103 211/187
4,934,645 A * 6/1990 Breslow ..... A47B 96/07 248/242
5,022,721 A * 6/1991 Melgers ..... A47B 57/52 312/257.1
5,199,778 A * 4/1993 Aoki ..... F25D 25/02 108/147
5,388,796 A * 2/1995 Sullivan ..... A47B 57/567 248/222.51
5,799,588 A * 9/1998 Engel ..... A47B 57/06 108/143
5,924,367 A * 7/1999 Henke ..... A47F 5/0087 108/108
6,641,098 B1 * 11/2003 Proffitt ..... A47B 57/42 248/242
6,837,467 B2 * 1/2005 Cheng ..... A47B 5/006 108/108
D622,990 S * 9/2010 Yang ..... D6/525
D643,990 S * 8/2011 Rouillard ..... D34/27
8,109,579 B2 * 2/2012 English ..... A47B 96/062 312/137
8,123,314 B2 * 2/2012 Becke ..... F25D 25/02 312/405.1
8,191,487 B2 * 6/2012 Theesfeld ..... F16M 11/24 108/50.01
8,297,575 B2 * 10/2012 Kluge ..... A47B 96/1466 248/235
9,261,305 B2 * 2/2016 Tunzi ..... F25D 27/00
9,277,820 B2 * 3/2016 Jacob ..... A47B 96/07
10,010,171 B2 * 7/2018 Neste ..... A47B 57/34
10,432,001 B1 * 10/2019 Bellis ..... A47B 47/02
10,568,423 B1 * 2/2020 McDowell ..... A47B 57/16
10,617,232 B2 * 4/2020 Taylor ..... A47B 57/06
2002/0043187 A1 * 4/2002 Felton ..... A47B 57/04 108/107
2003/0106475 A1 * 6/2003 Chen ..... A47B 46/00 108/134
2003/0121874 A1 * 7/2003 Koester ..... B62B 5/049 211/187
2006/0059934 A1 * 3/2006 Howington ..... A47B 57/045 62/251
2012/0223041 A1 * 9/2012 Lee ..... A47B 57/04 29/525.08
2014/0263128 A1 * 9/2014 Garrett ..... A47F 5/0815 211/144
2015/0096950 A1 * 4/2015 Engel ..... A47F 5/08 211/144
2018/0132612 A1 * 5/2018 Felsenthal ..... A47B 55/02
2020/0029686 A1 * 1/2020 Dinter ..... A47F 7/28
2020/0187675 A1 * 6/2020 Obitts ..... A47B 96/1408

* cited by examiner

FLEXIBLE SHELVING UNIT

INTRODUCTION

The present disclosure relates to shelving units and features for flexibly assembling shelving units and positioning shelves.

Shelving needs in a shop floor may be currently met by purchasing commercial off-the-shelf products. These products however are not commonly tailored for specific needs including the ability to select from multiple different shelf spacing and for shelf storage when not in use. Conventional shelving manufacturing methods to create customized shelves also require a long lead time and increase a cost of the units.

Thus, while current shelving units achieve their intended purpose, there is a need for a new and improved system and method for providing flexible and reduced cost shelving units.

SUMMARY

According to several aspects, a flexible shelving unit includes a support frame having at least one vertical guide rack, the at least one vertical guide rack including an elongated slot. The shelf unit is supported by the at least one vertical guide rack. The shelf unit includes a shelf plate framed by a front reinforcement portion and by at least one side reinforcement portion. The shelf unit when in a release position is moved to selected upward and downward locations by vertical displacement of at least one locating pin connected to and extending from the at least one side reinforcement portion which is positioned and sliding within the elongated slot. A flat end face of the at least one side reinforcement portion directly contacts a plate face of the at least one vertical guide rack with the at least one side reinforcement portion and the shelf plate in a horizontal position to frictionally retain the shelf unit in the horizontal position.

In another aspect of the present disclosure, the at least one vertical guide rack defines a first vertical guide rack and a second vertical guide rack positioned parallel to the first vertical guide rack, with the shelf unit supported by and between the first vertical guide rack and the second vertical guide rack.

In another aspect of the present disclosure, the at least one side reinforcement portion defines a first side reinforcement portion slidably disposed with respect to the first vertical guide rack and a second side reinforcement portion slidably disposed with respect to the second vertical guide rack.

In another aspect of the present disclosure, the at least one locating pin includes a first locating pin connected to and extending from the first side reinforcement portion and slidably disposed in the elongated slot of the first vertical guide rack and a second locating pin connected to and extending from the second side reinforcement portion and slidably disposed in the elongated slot of the second vertical guide rack.

In another aspect of the present disclosure, a u-shaped slot created in the at least one side reinforcement portion has a first slot portion and a second slot portion.

In another aspect of the present disclosure, a stopper pin is slidably positioned within the u-shaped slot and a hex nut is connected to the stopper pin, the hex nut having multiple flat faces.

In another aspect of the present disclosure, a frictional resistance against rotation of the at least one side reinforcement portion in the horizontal position is enhanced by a manual displacement of the stopper pin out of the first slot portion and into the second slot portion of the u-shaped slot, having one of the multiple flat faces of the hex-nut connected to the stopper pin directly contacting a planar face of the at least one vertical guide rack.

In another aspect of the present disclosure, the at least one side reinforcement portion includes a first side reinforcement portion oriented perpendicular to the front reinforcement portion and a second side reinforcement portion oriented perpendicular to the front reinforcement portion.

In another aspect of the present disclosure, at least one of the flat end face of the at least one side reinforcement portion and the plate face of the at least one vertical guide rack include a texture to enhance frictional contact, the texture defining at least one of ablation, a dimpling, a surface roughening, a diamond pattern and a cross-hatch pattern.

In another aspect of the present disclosure, a rounded corner of the at least one side reinforcement portion transitions into the flat end face, the rounded corner allowing the at least one side reinforcement portion to rotate upwardly to release the at least one side reinforcement portion from the horizontal position.

According to several aspects, a flexible shelving unit includes a first vertical guide rack having a first elongated slot and a second vertical guide rack having a second elongated slot. A shelf unit is supported by and between the first vertical guide rack and the second vertical guide rack, the shelf unit including a shelf plate framed by a front reinforcement portion, a first side reinforcement portion and a second side reinforcement portion. A first locating pin is connected to the first side reinforcement portion and is slidably positioned in the first elongated slot. A second locating pin is connected to the second side reinforcement portion and is slidably positioned in the second elongated slot. The shelf unit when in a horizontal position temporarily fixes the shelf unit for supporting an object on the shelf plate. The shelf unit when angularly positioned with respect to the horizontal position defines a release position allowing selected upward and downward displacement of the shelf unit.

In another aspect of the present disclosure, the first elongated slot and the second elongated slot individually include multiple angularly oriented slots extending at an angle beta ranging from approximately 15 degrees up to approximately 75-degrees in a downward direction with respect to a horizontal plane.

In another aspect of the present disclosure, the first locating pin connected to the first side reinforcement portion and the second locating pin connected to the second side reinforcement portion enter the angularly oriented slots with the shelf unit in the horizontal position.

In another aspect of the present disclosure, a shelf stowage slot is angularly oriented at an angle gamma ranging from approximately 15 degrees up to approximately 75-degrees in a downward direction with respect to a horizontal plane downwardly directed with respect to a horizontal plane, with the shelf stowage slot oppositely directed with respect to the angularly oriented slots about a longitudinal axis of the first elongated slot and the second elongated slot.

In another aspect of the present disclosure, a shelf resting notch and a reinforcement receiving notch open from a planar face of the first vertical guide rack and the second vertical guide rack and is commonly directed with the shelf stowage slot.

In another aspect of the present disclosure, when the first locating pin connected to the first side reinforcement portion and the second locating pin connected to the second side reinforcement portion enter the shelf stowage notch of the first vertical guide rack and the second vertical guide rack the shelf unit is rotated downwardly to a stowage position allowing a corner of the first side reinforcement portion and the second side reinforcement portion to enter the shelf resting notch and the reinforcement receiving notch of the first vertical guide rack and the second vertical guide rack.

In another aspect of the present disclosure, a first flat end face of the first side reinforcement portion having a first tab outwardly extending from the first flat end face directly contacts a plate face of the first vertical guide rack and a second flat end face of the second side reinforcement portion having a second tab outwardly extending from the second flat end face directly contacts a plate face of the second vertical guide rack having the first tab received in one of multiple sequentially spaced slots extending through the plate face of the first vertical guide rack and having the second tab received in one of multiple sequentially spaced slots extending through the plate face of the second vertical guide rack.

According to several aspects, a method to manufacture a shelving unit includes: selecting sheet materials and reinforcement members for making shelving components; cutting the reinforcement members and the sheet materials into predesigned shapes for forming multiple guiding racks, a main shelf body and a shelf surface; bending the reinforcement member into a shelf main body shape; and assembling the shelving unit.

In another aspect of the present disclosure, the method further includes: forming a curved feature and a flat contact surface defining the reinforcement member to be positioned at an end of shelf main body; creating extended tabs at an end of the reinforcement member; and adding slots to guiding rack side walls and a back wall to receive the extended tabs.

In another aspect of the present disclosure, the method further includes adding texture to predetermined contact surfaces between the reinforcement members and the guiding racks.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
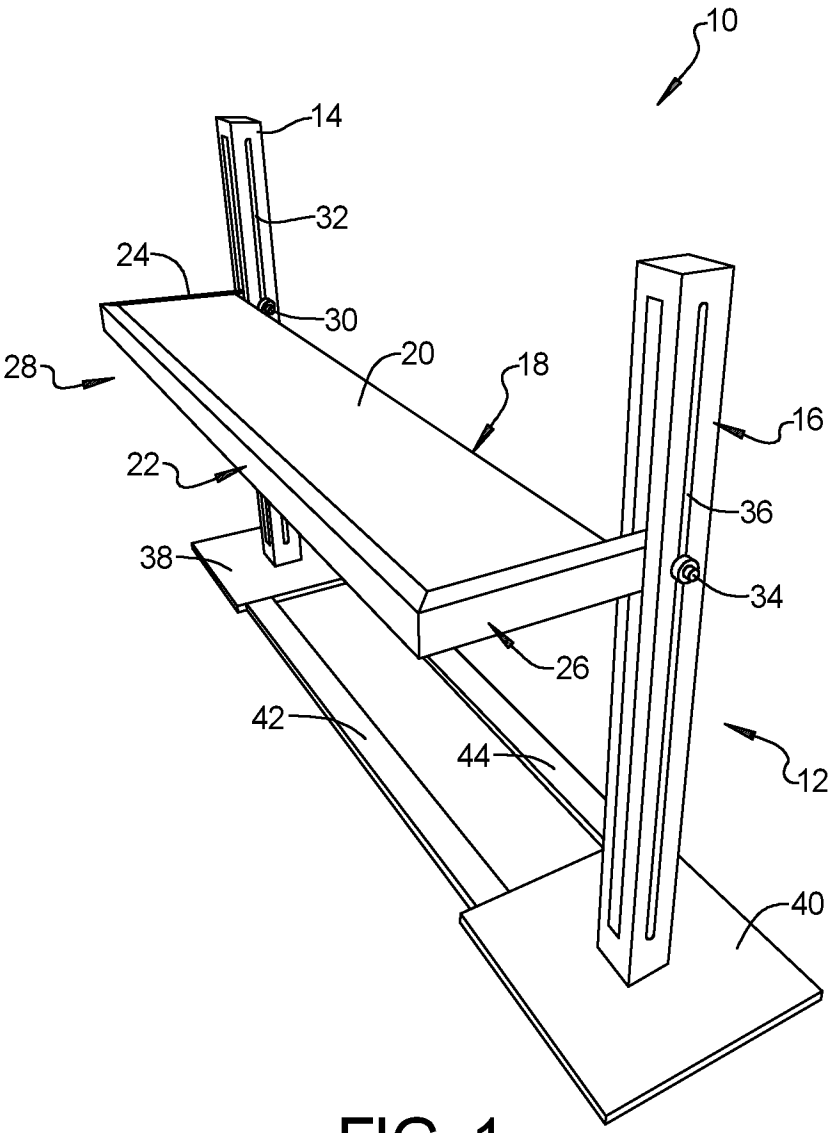
FIG. 1 is a left side perspective view of a flexible shelving unit according to an exemplary aspect.

Referring to FIG. 1, a flexible shelving unit 10 of the present disclosure includes a support frame 12 having a first vertical guide rack 14 and a second vertical guide rack 16 positioned parallel to the first vertical guide rack 14. A shelf unit 18 is supported by and between the first vertical guide rack 14 and the second vertical guide rack 16. The shelf unit 18 includes a shelf plate 20 made for example of a metal such as steel or aluminum. The shelf plate 20 is framed by a front reinforcement portion 22 and by a first side reinforcement portion 24 angularly oriented to the front reinforcement portion 22 forming a left-hand shelf side and a second side reinforcement portion 26 also angularly oriented to the front reinforcement portion 22 forming a right-hand shelf side. In the view of FIG. 1 the shelf unit 18 is shown in a shelf in-use, fixed horizontal position 28 available for storage of items onto the shelf plate 20. The shelf unit 18 may be moved to optional selected upward and downward horizontal positions different than the horizontal position 28 shown by vertical displacement of a first locating pin 30 connected to and extending from the first side reinforcement portion 24 which slides upwardly and downwardly within a first elongated slot 32 created in the first vertical guide rack 14 and a second locating pin 34 connected to and extending from the second side reinforcement portion 26 which slides upwardly and downwardly within a second elongated slot 36 created in the second vertical guide rack 16.

According to several aspects, reinforcement members and reinforcement portions of the present disclosure such as but not limited to the front reinforcement portion 22, the first side reinforcement portion 24 and the second side reinforcement portion 26 may be formed with any of multiple geometric shapes to enhance structural rigidity. These geometric shapes may include round, obround, I-beam-shaped, L-shaped, rectangular, combinations of the above, and the like. A rear corner of the shelf unit 18 may also include a reinforcement member positioned below the shelf plate 20 and extending for a width of the shelf unit 18 similar to the front reinforcement portion 22.

The support frame 12 may further include a first base plate 38 fixed to a bottom end of the first vertical guide rack 14 and a second base plate 40 fixed to a bottom end of the second vertical guide rack 16 which provide weight bearing stability for the flexible shelving unit 10. A first stiffening bracket 42 and a second stiffening bracket 44 may be fixed to the first base plate 38 and to the second base plate 40 to prevent the first vertical guide rack 14 from displacing away from the second vertical guide rack 16.

Referring to FIG. 2 and again to FIG. 1, the shelf unit 18 may be rotated from the shelf fixed and horizontal position 28 shown in FIG. 1 to a shelf stowed position 46 which is angled downwardly after rotation of the shelf unit 18 with respect to the first locating pin 30 and the second locating pin 34. The shelf unit 18 is releasably retained in the shelf fixed and horizontal position 28 shown in FIG. 1 and released to move to the shelf stowed position 46 using retaining features which are described in greater detail in reference to FIGS. 3 through 10 below.

Figure 2:
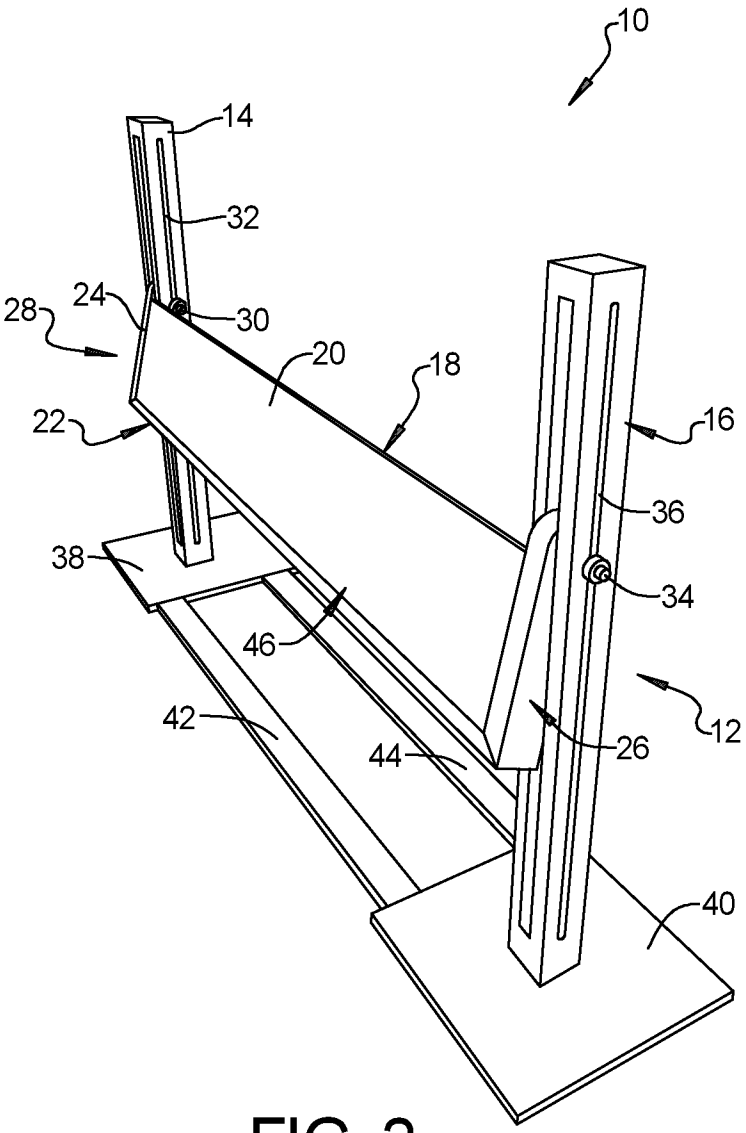
FIG. 2 is a left side perspective view of the flexible shelving unit of FIG. 1 in a shelf stowed configuration.

Referring to FIG. 3 and again to FIG. 2, the following discussion applies equally to both the first side reinforcement portion 24 and the second side reinforcement portion 26, with only the second side reinforcement portion 26 shown for simplicity. A first shelf retention system and method provides for a range of rotational motion of the shelf unit 18 between a released position oriented at an angle alpha (α) to a shelf locked position at the shelf in-use and horizontal position 28 shown in FIG. 1 by rotation of the shelf unit 18 with respect to the first locating pin 30 and the second locating pin 34 (only the second locating pin 34 is shown in this view for clarity) which are positioned in the elongated slots such as the second elongated slot 36 shown. The shelf unit 18 rotates from the released position oriented at the angle alpha (α) to the locked position aligned on a horizontal plane 48 as follows.

The shelf unit 18 includes a u-shaped slot 50 in each of the side reinforcement portions with only the second side reinforcement portion 26 shown for clarity, which include a downward directed first slot portion 52 communicating by a connecting slot portion 53 to a downward directed second slot portion 54 which is parallel to the first slot portion 52. An assisting stopper assembly 57 is slidably disposed in individual ones of the u-shaped slots 50. The assisting stopper assemblies 57 individually include a stopper pin 58 which is slidably positioned in the U-shaped slot 50 and a hex-nut 60 connected to the stopper pin 58. When the shelf unit 18 is released for upward and downward sliding motion as shown in the upper portion of FIG. 3, having the second side reinforcement portion 26 angularly oriented to the angular orientation 26*a* defining a released position of the second side reinforcement portion 26, the stopper pin 58 is positioned in the first slot portion 52.

The second side reinforcement portion 26 further includes a rounded corner 62 which transitions into a flat end face 64. The rounded corner 62 provides clearance for rotation of the second side reinforcement portion 26. By rotating the second side reinforcement portion 26 with respect to the second locating pin 34, a bottom face 66 of the second side reinforcement portion 16 is transitioned from the released position 26*a* oriented at the angle α to a horizontal shelf unit fixed position having the bottom face 66 aligned with a horizontal plane 68.

At the shelf unit fixed position with the second side reinforcement portion 26 oriented horizontally the flat end face 64 directly contacts a plate face 70 of the second vertical guide rack 16, which thereafter provides frictional resistance against further upward or downward displacement of the second side reinforcement portion 26 and resists the gravity force 72 acting to pull the second side reinforcement portion 26 downwardly under load. This frictional resistance is enhanced by manually displacing the stopper pin 58 out of the first slot portion 52 and through the connecting slot portion 53 into the second slot portion 54 of the u-shaped slot 50. When the stopper pin 58 is positioned in the second slot portion 54 one of multiple flat faces 74 of the hex-nut 60 connected to the stopper pin 58 directly contacts a planar face 76 of the second vertical guide rack 16 which is oriented parallel to the plate face 70. This direct contact provides further resistance against rotation of the second vertical guide rack 16 with respect to the second locating pin 34.

Figure 3:
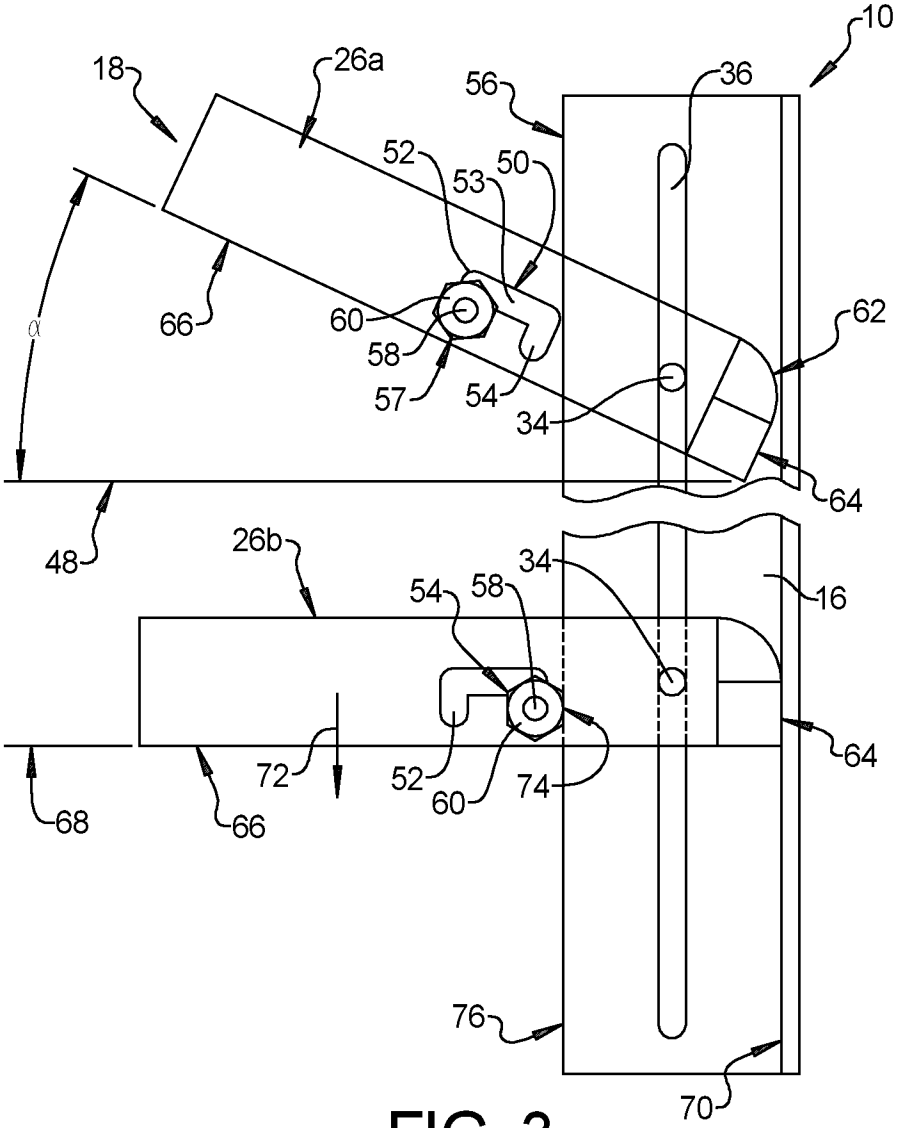
FIG. 3 is a side elevational view of a shelf rotation and locking system for a flexible shelving unit according to an exemplary aspect.
Figure 6:
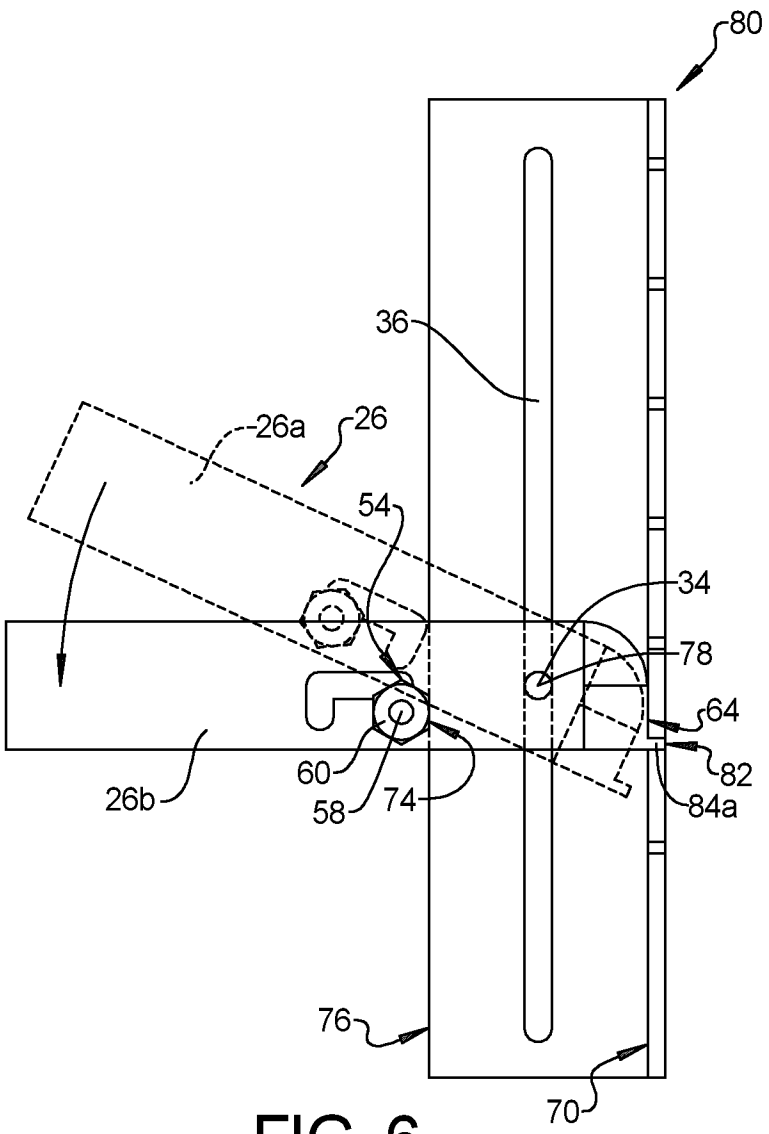
FIG. 6 is a side elevational view showing axial rotation of the flexible shelving unit of FIG. 5.

Referring to FIG. 4 and again to FIG. 3, rotation of the second side reinforcement portion 26 occurs about a central axis 78 of the second locating pin 34 between the released position 26*a* and the fixed position 26*b* of the second side reinforcement portion 26. The second locating pin 34 is sized to provide a sliding fit within the second elongated slot 36, thereby allowing free vertical sliding motion of the second locating pin 34 while minimizing horizontal displacement of the second locating pin 34 and thereby minimizing horizontal displacement of the second side reinforcement portion 26.

Referring to FIG. 5 and again to FIGS. 1 through 4, the following discussion applies equally to both the first side reinforcement portion 24 and the second side reinforcement portion 26, with only the second side reinforcement portion 26 shown for simplicity. A second shelf retention system and method 80 is modified to add a positive engagement extended tab 82 to the second side reinforcement portion 26. The plate face 70 of the second vertical guide rack 16 is modified to add multiple, sequentially spaced slots 84 extending through the plate face 70. As the second side reinforcement portion 26 is rotated from the released position 26*a* toward the fixed position 26*b*, the second vertical guide rack 16 may be upwardly or downwardly displaced until the extended tab 82 aligns with and enters a desired one of the multiple sequentially spaced slots 84, for example with a slot 84*a* shown. Upon complete rotation of the second vertical guide rack 16 to the fixed position 26*b*, the extended tab 82 is fully seated in the selected slot 84*a*, and the flat end face 64 directly and frictionally contacts the plate face 70. As previously described herein, the stopper pin 58 is displaced out of the first slot portion 52 and into the second slot portion 54 of the u-shaped slot 50. One of multiple flat faces 74 of the hex-nut 60 connected to the stopper pin 58 directly contacts the planar face 76 of the second vertical guide rack 16 to secure the fixed position 26*b*.

Figure 4:
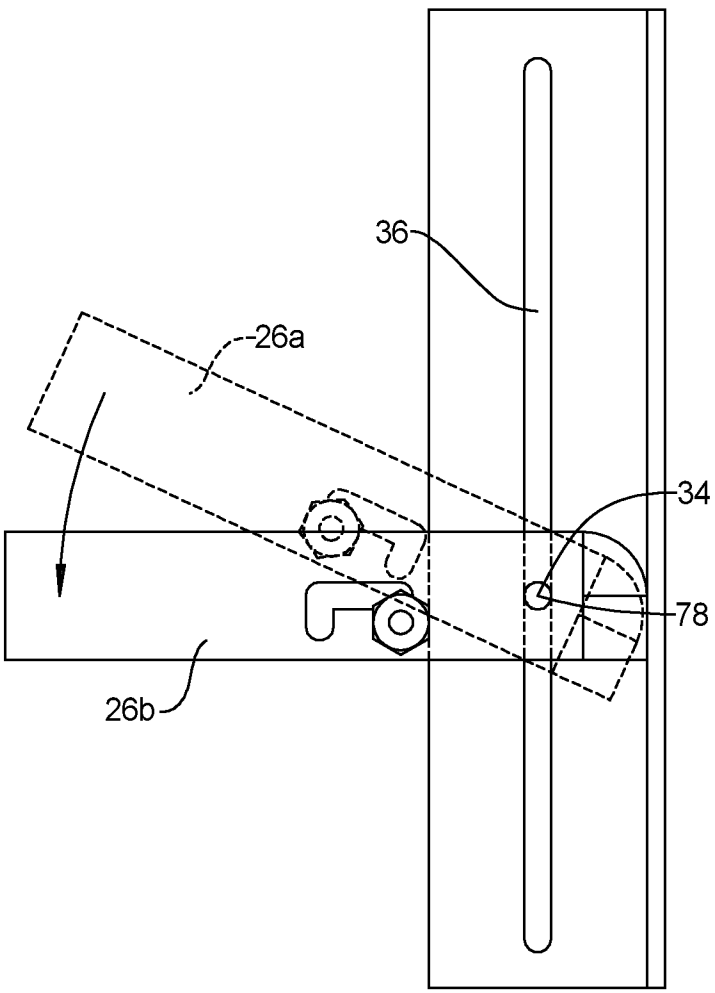
FIG. 4 is a side elevational view showing axial rotation of the flexible shelving unit of FIG. 3.
Figure 5:
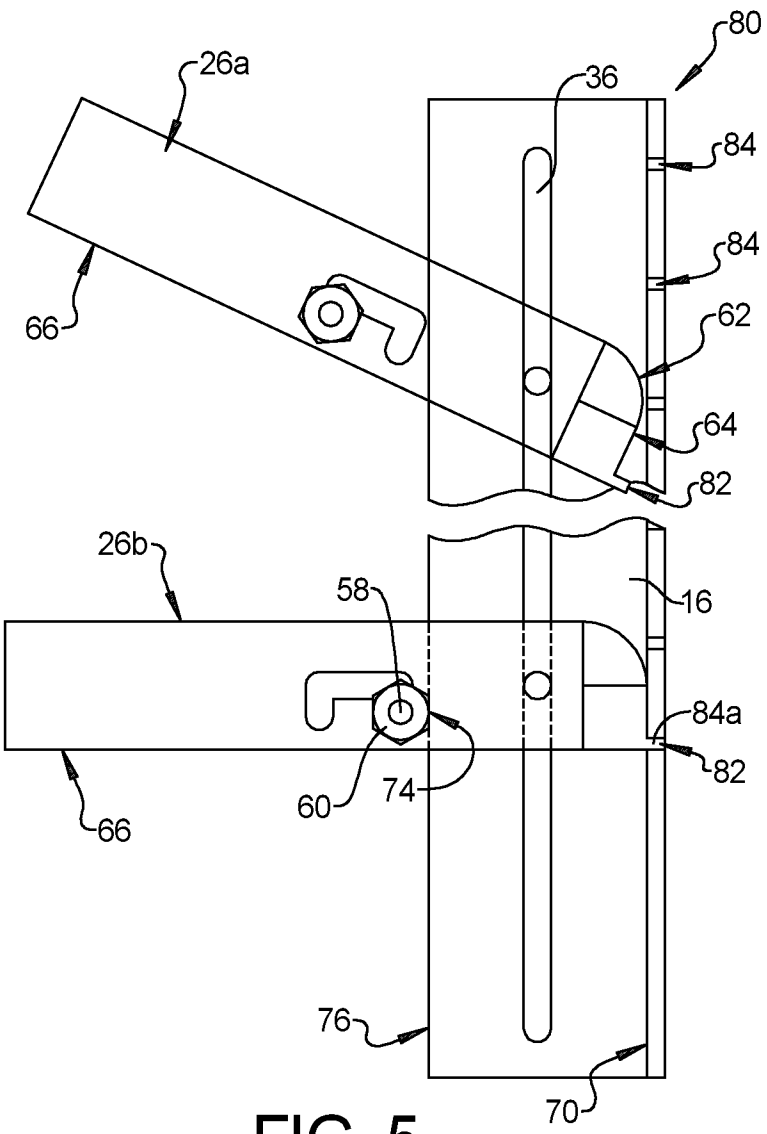
FIG. 5 is a side elevational view of another shelf rotation and locking system for a flexible shelving unit according to an exemplary aspect.

Referring to FIG. 6 and again to FIGS. 4 and 5, rotation of the second side reinforcement portion 26 for the second shelf retention system and method 80 occurs about a central axis 78 of the second locating pin 34 between the released position 26*a* and the fixed position 26*b* of the second side reinforcement portion 26. The flat end face 64 directly and frictionally contacts the plate face 70 of the second vertical guide rack 16.

Referring to FIG. 7 and again to FIGS. 1 through 6, a third shelf retention system and method 86 modifies the second vertical guide rack 16 to produce a modified vertical guide rack 88. The modified vertical guide rack 88 includes an elongated slot 90 similar to the second elongated slot 36, opening into the elongated slot 90 however, additional angularly oriented slots 92 such as angularly oriented slots 92*a*, 92*b*, 92*c* individually extend at an angle beta (β) ranging from approximately 15 degrees up to approximately 75 degrees in a downward direction with respect to a horizontal plane 94 oriented perpendicular to the elongated slot 90.

Figure 7:
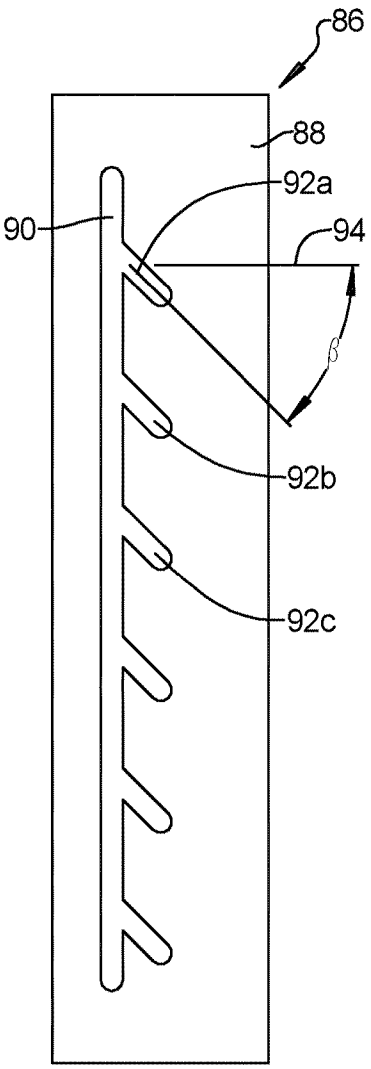
FIG. 7 is a side elevational view of a vertical guiding rack of a further exemplary aspect.
Figure 10:
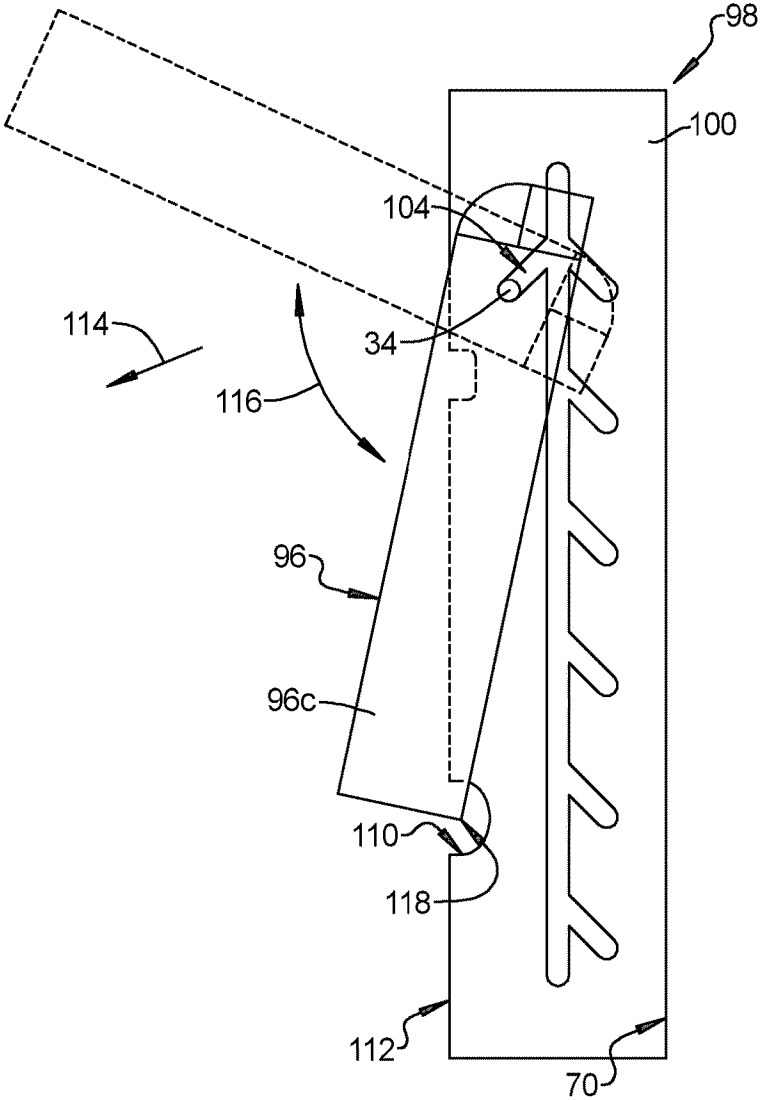
FIG. 10 is a side elevational view of a shelf rotation and stowage system using the vertical guiding rack of FIG. 9.

Referring to FIG. 8 and again to FIG. 7, the third shelf retention system and method 86 provides an alternate locking mechanism from the assisting stopper assembly 57 by use of the angularly oriented slots 92 such as angularly oriented slots 92*a*, 92*b*, 92*c*. A side reinforcement portion 96 is modified from the second side reinforcement portion 26 to eliminate the u-shaped slots 50. The second locating pin 34 extending from the side reinforcement portion 96 traveling within the elongated slot 90 encounters a desired one of the angularly oriented slots 92 such as the angularly oriented slot 92*b* shown. The side reinforcement portion 96 is manually displaced to force the second locating pin 34 into the angularly oriented slot 92*b*. The side reinforcement portion 96 may then be rotated from a released position 96*a* toward a fixed position 96*b*. When the second locating pin 34 contacts an end wall 98 of the selected angularly oriented slot 92*b* the flat end face 64 of the side reinforcement portion 96 directly and frictionally contacts the plate face 70 of the vertical guide rack 88 establishing the fixed position 96*b*. The downward configuration of the angularly oriented slot 92*b* frictionally resists horizontal motion of the side reinforcement portion 96 which would release the side reinforcement portion 96. To release the side reinforcement portion 96 from the fixed position, an opposite sliding motion and rotation of the side reinforcement portion 26 releases contact of the flat end face 64 with the plate face 70, allowing the second locating pin 34 to be retracted back into the elongated slot 90.

Figure 8:
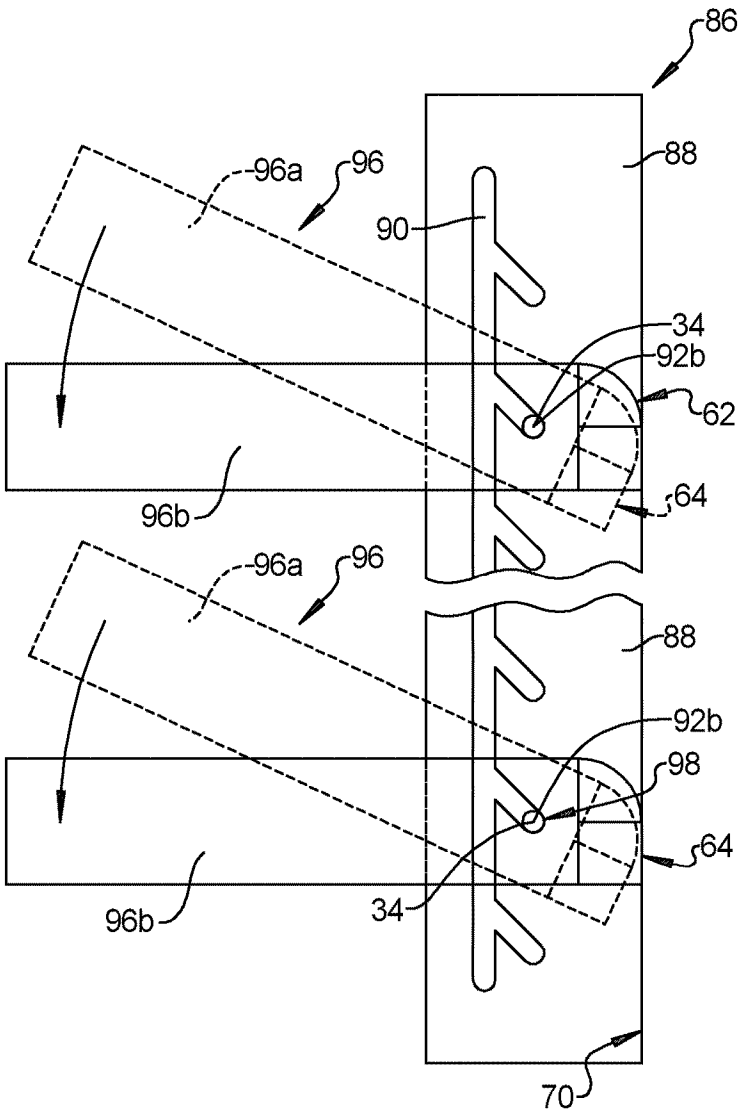
FIG. 8 is a side elevational view of a shelf rotation and locking system using the vertical guiding rack of FIG. 7.

Referring to FIG. 9 and again to FIGS. 7 and 8, a fourth shelf retention system and method 98 further modifies the second vertical guide rack 16 and the vertical rack 88 to produce a modified vertical guide rack 100. The modified vertical guide rack 100 includes an elongated slot 102 similar to the elongated slot 90 having the additional angularly oriented slots 92 such as angularly oriented slots 92*a*, 92*b*, 92*c*, and further including at least one shelf stowage slots 104 (only one of which is shown for clarity) which are angularly oriented at an angle gamma (γ) ranging from approximately 15 degrees up to approximately 75 degrees downwardly directed with respect to a horizontal plane 106. The at least one shelf stowage slot 104 is oppositely directed with respect to the angularly oriented slots 92 about a longitudinal axis of the elongated slot 102. The modified vertical guide rack 100 may further include at least one first shelf resting notch 108 and at least one second shelf resting notch 110 opening from a planar face 112 of the modified vertical rack 100 and commonly directed with the at least one shelf stowage slot 104.

Figure 9:
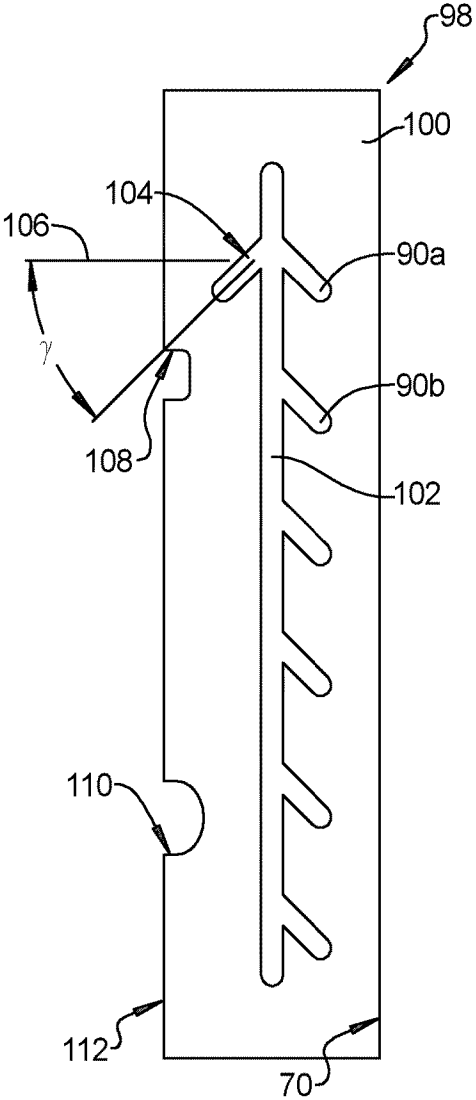
FIG. 9 is a side elevational view of a vertical guiding rack of a further exemplary aspect.

Referring to FIG. 10 and again to FIGS. 8 and 9, the modified vertical guide rack 100 may be used to provide a shelf stowed position 96*c* of the side reinforcement portion 96 as follows. The side reinforcement portion 96 is displaced until the second locating pin 34 encounters the at least one shelf stowage slot 104. Thereafter, a force applied to the side reinforcement portion 96 in a direction 114 pulls the second locating pin 34 into the at least one shelf stowage slot 104. As the second locating pin 34 traverses into the shelf stowage slot 104 the side reinforcement portion 96 may be rotated in a counterclockwise direction of rotation 116 about a center axis of the second locating pin 34. This rotation allows a reinforcement portion of the shelf unit to enter the at least one first shelf resting notch 108, and a corner 118 of the side reinforcement portion 96 to enter the at least one second shelf resting notch 110, thereby aiding in retaining the shelf stowed position 96*c*.

With continuing reference to FIGS. 1, 3-6 and 8, to further enhance the frictional contact obtained by contact of a flat end face such as the flat end face 64 with the plate face 70 of a vertical guide rack, a texture is added to all the contact surfaces including at least one of the flat end face 64 and the plate face 70. The texture may be in the form of ablation, dimpling, a surface roughening, a diamond pattern, a cross-hatch pattern or the like.

Figure 11:
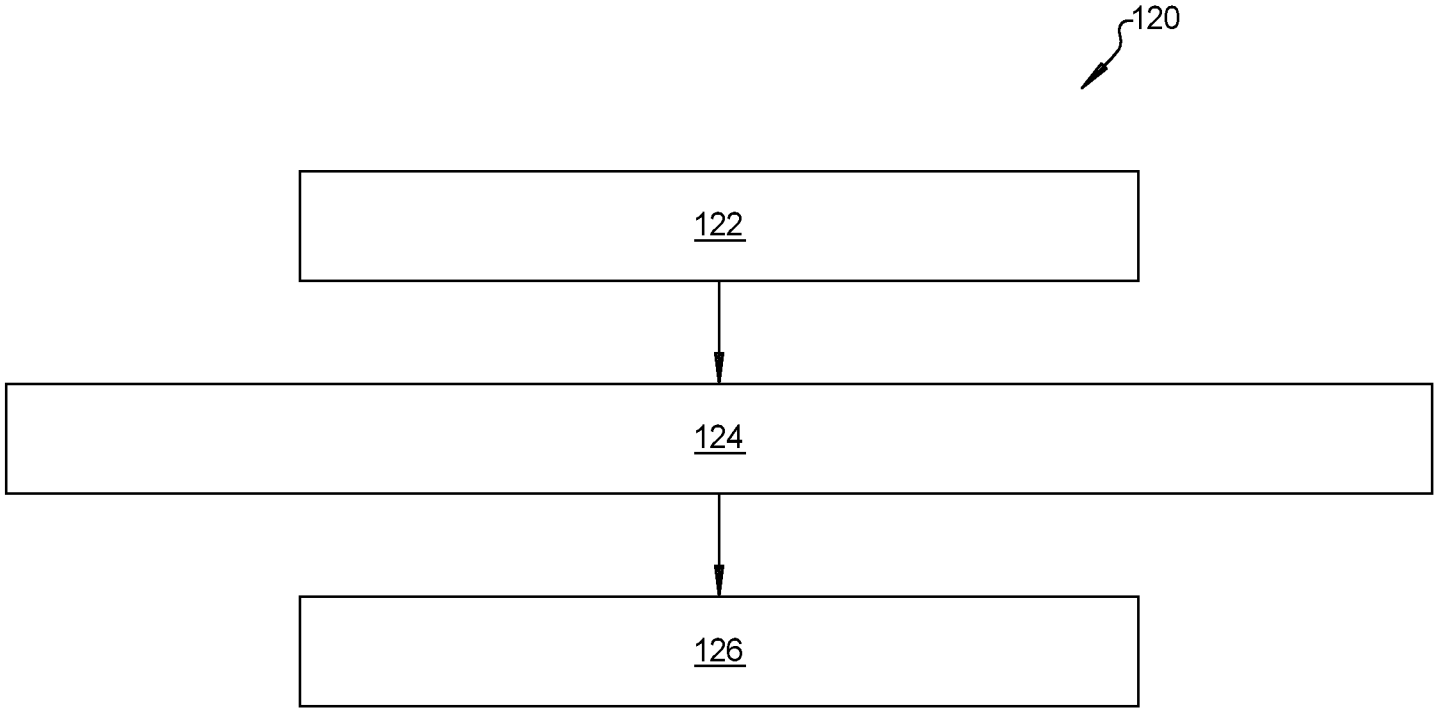
FIG. 11 is a flow diagram of method steps for assembling a flexible shelving unit of the present disclosure.

Referring to FIG. 11 a method for manufacturing a shelving system 120 of the present disclosure includes in a first step 122 selecting sheet materials and appropriate-size reinforcement members for making the desired shelving components. In a second step 124, the reinforcement members and the sheet materials are cut into predesigned shapes for guiding racks, the main shelf body and the shelf surface. The features include 1) a curved feature and a flat contact surface for a small reinforcement member at an end of shelf main body; 2) extended tabs are provided at an end of the small reinforcement member if needed; 3) slots are added to the guiding rack side walls and a back wall if needed; and 4) texture is added to all the contact surfaces as desired. In a final step 126, the reinforcement member is bent into the shelf main body shape, and the shelving unit is assembled.

The flexible shelving unit consists of guiding racks, shelves, pins and stoppers. The shelves have end shapes which consist of a curve to allow rotation and easy disengagement and adjustment in position, and a flat surface for contact with the rack back wall and self-locking via a friction force.

The guiding racks are for the shelves to sit in and move up/down. The racks can have slots in the side walls for the shelf locating pins to sit in for locking-in positions in the presence of vibration. The racks can have back-wall slots for shelf's tabs to go in for additional locking in positions. The guiding racks can also have slots in the side walls for the shelf to back out, fold down and rest in place. All the contact surfaces can be textured to increase friction. The texturing methods can be ablation, dimpling and others.

The design of the present shelving unit includes simple components including: shelves, locating pins, stoppers and guiding racks. The shelf consists of a main body made of multiple reinforcement members and a shelf surface made of a metal sheet. The side reinforcement members of the shelf main body may include a unique end shape, having a curve to allow rotation and adjustment, and a flat surface to promote contact with the rack back wall. The present design of the shelving unit has gravity/weight-activated locking mechanisms for the shelves using friction forces, and also includes designed slots in the guiding racks to prevent slippage in the presence of vibration.

The present shelving units provide slots for the shelf to back-out and sit-in and for the shelf main body to rest in-place when folding down. The design of the present shelving unit promotes all or important contact surfaces to be textured to promote increased friction. The texturing methods to enhance friction can be ablation, dimpling and others.

The design of the present shelving unit may use a laser cutting system to design and manufacture flexible shelving units using metal sheets and reinforcement members within 20-30 minute turnaround times.

A shelving unit of the present disclosure offers several advantages. These include a shelving system which consists of predefined shapes for self-locking and additional features for locking the shelves in positions in the presence of vibration. The present system also offers flexible adjustment of shelf positions via friction force or slots. Additional slots can be added to allow a shelf to fold down and lock in-place when the shelf is not in service. The present system can be fabricated in a laser cutting system starting from metal sheets within approximately 20-30 minutes.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. A flexible shelving unit, comprising:

a support frame having at least one vertical guide rack, the at least one vertical guide rack including an elongated slot;

a shelf unit supported by the at least one vertical guide rack, the shelf unit including a shelf plate framed by a front reinforcement portion and by at least one side reinforcement portion, wherein the shelf unit when in a release position is movable to selected upward and downward locations by vertical displacement of at least one locating pin connected to and extending from the at least one side reinforcement portion which is positioned and slidable within the elongated slot;

a flat end face of the at least one side reinforcement portion directly contacting a plate face of the at least one vertical guide rack with the at least one side reinforcement portion and the shelf plate in a horizontal position to frictionally retain the shelf unit in the horizontal position;

a u-shaped slot in the at least one side reinforcement portion having a first slot portion and a second slot portion; and a stopper pin slidably positioned within the u-shaped slot and a hex nut connected to the stopper pin, the hex nut having multiple flat faces, wherein a frictional resistance against rotation of the at least one side reinforcement portion in the horizontal position is enhanced by a manual displacement of the stopper pin out of the first slot portion and into the second slot portion of the u-shaped slot, having one of the multiple flat faces of the hex-nut connected to the stopper pin directly contacting a planar face of the at least one vertical guide rack.

2. The flexible shelving unit of claim 1, wherein the at least one vertical guide rack defines a first vertical guide rack and a second vertical guide rack positioned parallel to the first vertical guide rack, with the shelf unit supported by and between the first vertical guide rack and the second vertical guide rack.

3. The flexible shelving unit of claim 2, wherein the at least one side reinforcement portion defines a first side reinforcement portion slidably disposed with respect to the first vertical guide rack and a second side reinforcement portion slidably disposed with respect to the second vertical guide rack.

4. The flexible shelving unit of claim 2, wherein the at least one locating pin includes a first locating pin connected to and extending from the first side reinforcement portion and slidably disposed in the elongated slot of the first vertical guide rack and a second locating pin connected to and extending from the second side reinforcement portion and slidably disposed in the elongated slot of the second vertical guide rack.

5. The flexible shelving unit of claim 1, wherein the at least one side reinforcement portion includes a first side reinforcement portion angularly oriented to the front reinforcement portion and a second side reinforcement portion angularly oriented to the front reinforcement portion.

6. The flexible shelving unit of claim 1, wherein at least one of the flat end face of the at least one side reinforcement portion and the plate face of the at least one vertical guide rack include a texture to enhance frictional contact, the texture defining at least one of ablation, a dimpling, a surface roughening, a diamond pattern and a cross-hatch pattern.

7. The flexible shelving unit of claim 1, further including a rounded corner of the at least one side reinforcement portion transitioning into the flat end face, the rounded corner allowing the at least one side reinforcement portion to rotate upwardly to release the at least one side reinforcement portion from the horizontal position.

8. The flexible shelving unit of claim 3, wherein a first flat end face of the first side reinforcement portion having a first tab outwardly extending from the first flat end face directly contacts a plate face of the first vertical guide rack and a second flat end face of the second side reinforcement portion having a second tab outwardly extending from the second flat end face directly contacts a plate face of the second vertical guide rack having the first tab received in one of multiple sequentially spaced slots extending through the plate face of the first vertical guide rack and having the second tab received in one of multiple sequentially spaced slots extending through the plate face of the second vertical guide rack thereby frictionally retaining the shelf unit in the horizontal position.

9. A flexible shelving unit, comprising:

a support frame having a first vertical guide rack and a second vertical guide rack parallel to the first vertical guide rack, the first vertical guide rack including an elongated slot;

a shelf unit supported by and between the first vertical guide rack and the second vertical guide rack, the shelf unit including a shelf plate framed by a front reinforcement portion and a first side reinforcement portion and a second side reinforcement portion each angularly oriented relative to the front reinforcement portion, the shelf unit when in a release position moved to selected upward and downward locations by vertical displacement of a first locating pin connected to and extending from the first side reinforcement portion which is positioned and sliding within the elongated slot;

a flat end face of the first side reinforcement portion directly contacting a plate face of the first vertical guide rack with the first side reinforcement portion and the shelf plate in a horizontal position to frictionally retain the shelf unit in the horizontal position, wherein the flat end face of the first side reinforcement portion includes a first tab outwardly extending from the first flat end face that directly contacts a plate face of the first vertical guide rack and having the first tab received in one of multiple sequentially spaced slots extending through the plate face of the first vertical guide rack thereby frictionally retaining the shelf unit in the horizontal position;

a rounded corner of the first side reinforcement portion transitioning into the flat end face, the rounded corner allowing the first side reinforcement portion to rotate upwardly to release the first side reinforcement portion from the horizontal position;

a u-shaped slot disposed in first side reinforcement portion having a first slot portion and a second slot portion; and a stopper pin slidably positioned within the u-shaped slot and a hex nut connected to the stopper pin, the hex nut having multiple flat faces, wherein a frictional resistance against rotation of the first side reinforcement portion in the horizontal position is enhanced by a manual displacement of the stopper pin out of the first slot portion and into the second slot portion of the u-shaped slot, having one of the multiple flat faces of the hex-nut connected to the stopper pin directly contacting a planar face of the first vertical guide rack, and wherein at least one of the flat end face of the first side reinforcement portion and the plate face of the first vertical guide rack include a texture to enhance frictional contact, the texture defining at least one of ablation, a dimpling, a surface roughening, a diamond pattern and a cross-hatch pattern.

* * * * *